US005142292A

United States Patent [19]

Chang

[11] Patent Number: 5,142,292

[45] Date of Patent: Aug. 25, 1992

[54] COPLANAR MULTIPLE LOOP ANTENNA FOR ELECTRONIC ARTICLE SURVEILLANCE SYSTEMS

[75] Inventor: Luke C. Chang, West Deptford, N.J.

[73] Assignee: Checkpoint Systems, Inc., Thorofare, N.J.

[21] Appl. No.: 740,278

[22] Filed: Aug. 5, 1991

[51] Int. Cl.[5] ..... H01Q 11/12

[52] U.S. Cl. ..... 343/742; 343/867; 340/572

[58] Field of Search ..... 343/742, 866, 867; 340/572

[56] References Cited

U.S. PATENT DOCUMENTS

| | | | |
|---|---|---|---|
| 3,665,449 | 5/1972 | Elder et al. | 340/280 |
| 4,016,553 | 4/1977 | Novikoff et al. | 340/280 |
| 4,118,693 | 10/1978 | Novikoff | 340/572 |
| 4,251,808 | 2/1981 | Lichtblau | 340/572 |
| 4,373,163 | 2/1983 | Vandebult | 343/842 |
| 4,498,076 | 2/1985 | Lichtblau | 340/572 |
| 4,633,250 | 12/1986 | Anderson et al. | 342/27 |
| 4,782,342 | 11/1988 | Walton | 340/941 |
| 4,845,509 | 7/1989 | Asbrink | 343/867 |
| 4,864,280 | 9/1989 | van der Meij | 340/572 |
| 4,866,455 | 9/1989 | Lichtblau | 343/742 |
| 4,872,018 | 10/1989 | Feltz et al. | 343/742 |
| 4,999,641 | 3/1991 | Cordery et al. | 343/742 |

*Primary Examiner*—Akm E. Ullah
*Assistant Examiner*—Robert E. Wise
*Attorney, Agent, or Firm*—Panitch Schwarze Jacobs & Nadel

[57] ABSTRACT

An antenna for transmitting electromagnetic energy for deactivating a resonant tag circuit of an electronic article surveillance tag without regard to the orientation of the tag while minimizing far field radiation. The antenna includes a substantially planar dielectric substrate having a first side and a second side. The antenna also includes four substantially coplanar conductive loops on the first side of the dielectric substrate. The conductive loops are arranged in a two-by-two sequence and connected in series such that current flowing through any one of the conductive loops is out of phase with respect to current flowing in each adjacent conductive loop. The antenna also includes a ground trace on the second side of the substrate.

9 Claims, 2 Drawing Sheets

COPLANAR MULTIPLE LOOP ANTENNA FOR ELECTRONIC ARTICLE SURVEILLANCE SYSTEMS

FIELD OF THE INVENTION

The invention relates to an antenna for electronic article surveillance (EAS) systems and, more particularly, to a coplanar multiple loop antenna for transmitting electromagnetic energy for deactivating a resonant circuit of an electronic article surveillance tag.

BACKGROUND OF THE INVENTION

The unauthorized removal of articles from a surveillance area may be deterred by attaching tags including inductor/capacitor resonant circuits to articles within the surveillance area and generating an electromagnetic field of predetermined frequency in a controlled area to detect the passage of tagged articles therethrough. The tag circuit, which resonates at the frequency of the electromagnetic field, may be detected by the receiving component of an EAS system to indicate the unauthorized removal of the tagged article from the surveillance area.

To prevent the tag from activating the security system when the tagged article is to be legitimately removed from the surveillance area, the tag must either be removed or deactivated. Removal of tags is both labor and time intensive and therefore is generally considered to be too inefficient to be employed. Deactivatible EAS tags are disclosed in U.S. Pat. No. 4,498,076, which is hereby incorporated by reference. It is preferred that the tag be deactivated by exposure to an electromagnetic field of corresponding frequency and sufficient power to effectively overload and short-circuit the capacitor portion of the tag so that the tag no longer resonates at the frequency of the EAS system, if at all.

To reduce the possibility of accidentally deactivating a tag circuit, it is preferred that the energy transmitted for deactivation be confined to a relatively small area. To meet federal emission regulations and emission regulations of other countries, the preferred deactivation antenna employed for radiating deactivation energy must effectively cancel far field radiation.

For aesthetic and practical reasons, it is also desirable to have an unobtrusive deactivation antenna. For example, retail establishments generally prefer unobtrusive antennas to avoid offending customers. It would be particularly advantageous to have available a substantially planar deactivating antenna small enough to be incorporated into a standard checkout counter, yet strong enough to withstand rigorous daily use.

The effectiveness of many prior art deactivation antennas is often contingent upon the orientation of the tag with respect to the antenna. For example, some prior art deactivation antennas require that the tag be aligned face down and in the center of the antenna in order to achieve effective deactivation. It would be advantageous to have a deactivation antenna wherein the orientation of the tag does not hinder the deactivation process, i.e., the tag can be deactivated without having to be placed in a particular orientation. The present invention overcomes the shortcomings discussed above, as well as many other shortcomings of prior art deactivation antennas.

SUMMARY OF THE INVENTION

One aspect of the present invention is an antenna for transmitting electromagnetic energy for deactivating a resonant tag circuit of an electronic article surveillance tag without regard to the orientation of the tag, while minimizing far field radiation. The antenna comprises a substantially planar dielectric substrate having a first side and a second side. Four substantially coplanar conductive loops are arranged on the first side of the dielectric substrate. The conductive loops are arranged in a two-by-two sequence and are connected in series such that current flowing through any one of the conductive loops is out of phase with respect to current flowing in each adjacent conductive loop. The antenna further comprises a ground trace on the second side of the substrate.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF PREFERRED EMBODIMENTS

Certain terminology is used in the following description for convenience only and is not limiting.

Figure 1:
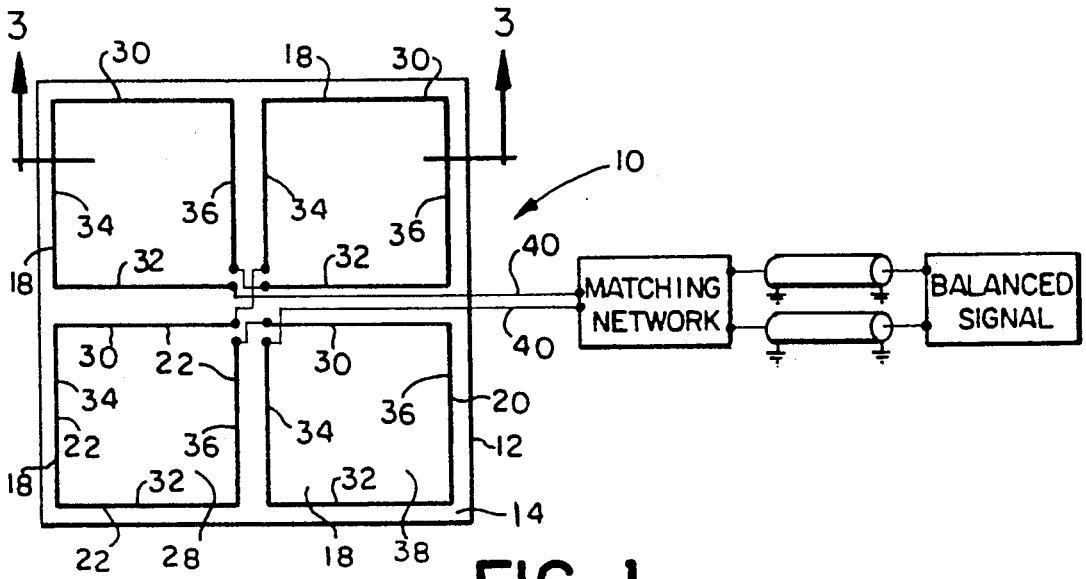
FIG. 1 is a schematic diagram of a deactivation antenna showing the first side of a dielectric substrate with antenna loops, in accordance with the present invention.

Referring to the drawings, wherein like numerals indicate like elements throughout, there is shown in FIG. 1 a preferred embodiment of an antenna, generally designated 10, for transmitting electromagnetic energy for deactivating a resonant tag circuit (not shown) of an electronic article surveillance, (EAS) tag.

The electromagnetic energy to be transmitted by the antenna 10 is comprised of two components, namely electrostatic and magnetic energy. The level of energy transmitted by the antenna 10 must be sufficient to deactivate the resonant tag circuit within the transmission range of the antenna 10 without regard to the orientation of the tag.

In addition to having the capability of deactivating a resonant tag circuit presented at any orientation with respect to the antenna 10, the antenna 10 of the present invention is capable of effectively minimizing far field radiation. Far field radiation is electromagnetic signals which are strong enough to travel beyond the immediate vicinity of the antenna, possibly interfering with the operation of other devices. In various countries, such as the United States and Germany, transmitting antennas must meet specified radiation emission standards. Federal regulations specify that far field radiation must be effectively cancelled at a vertical or horizontal distance of thirty meters from the antenna. The antenna 10 of the present invention effectively meets this standard while providing adequate near field power for effective tag deactivation without regard to tag orientation.

The antenna 10 of the present invention comprises a substantially planar dielectric substrate 12. The substantially planar configuration makes the antenna 10 of the present invention useful for incorporation into checkout counters, walls, doorways, and other locations of sufficient size to accommodate the antenna 10, as are well known to one of ordinary skill in the art.

Preferably, the dielectric substrate comprises a printed circuit board, such as the product FR-4 Printed Circuit Board, which is commercially available from Hadco of New Hampshire. However, it should be understood by one of ordinary skill in the art that the dielectric substrate 12 may be made from any of a variety of polymeric materials, such as polyethylene, polyvinyl chloride, polystyrene, and other engineering thermoplastic and thermosetting materials.

Figure 3:
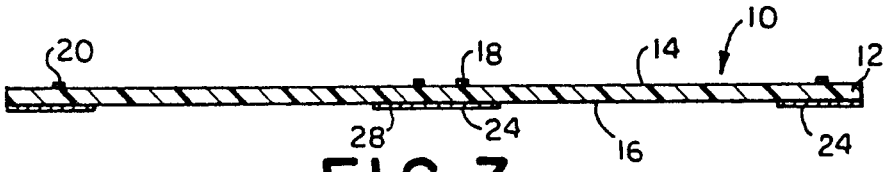
FIG. 3 is a cross-sectional view taken along line 3—3 of FIG. 1.

As best shown in FIG. 3, the dielectric substrate 12 includes a first side 14 and a second side 16. As best shown in FIG. 1, the antenna 10 also includes four substantially coplanar conductive loops 18 on the first side 14 of the dielectric substrate 12.

In the present embodiment, it is preferred that the conductive loops 18 be positioned on the substrate 12 by etching. For example, the conductive loops 18 may be etched onto the substrate 12 by first applying a layer of conductive material onto the substrate, then forming a protective coating over the conductive loop portion of the layer of conductive material which is to remain on the substrate 12. The surrounding conductive material may be etched away, leaving the conductive material comprising the conductive loops 18 remaining on the substrate 12. One of ordinary skill in the art would understand that the conductive loops 18 may also be positioned on the dielectric substrate 12 by any method which securely fastens the loops 18 onto the substrate 12, such as by the use of adhesives, fastening means, and other means well within the knowledge of one having ordinary skill in the art.

Preferably, the conductive loops are formed of copper. However, one of ordinary skill in the art would understand that the conductive loops 18 may be formed from any conductive material, such as brass, aluminum, steel or other metals in keeping with the spirit and scope of the present invention.

In the present embodiment, it is preferred that each conductive loop 18 comprise a printed circuit track 20 of predetermined width which defines a loop boundary 22. The predetermined width of the printed circuit track is preferably about 0.1 inches to 0.3 inches. Preferably, each loop defines a loop area 28 of generally equal size. It is further preferred that each loop 18 have a generally square configuration, as best shown in FIG. 1.

The conductive loops 18 are arranged in a two-by-two sequence and are electrically connected in series such that current flowing through any one of the conductive loops 18 is preferably 180° out of phase with respect to current flowing in each adjacent conductive loop 18. Preferably, the loops 18 are connected in series such that the current in each loop 18 flows in a first direction which is opposite to a second direction in which current flows in each adjacent loop 18. For example, current flowing in the upper left-hand loop (when viewing FIG. 1) and the lower right-hand loop flows in a clockwise direction and current in the other two loops flows in a counterclockwise direction.

Connection of the loops in series in this manner and defining generally equal areas 28 within each loop boundary 22 contributes to the excellent far field cancellation of the present antenna 10. Since the field generated by each conductive loop 18 is of equal magnitude and 180° with respect to each adjacent loop 18, each loop 18 generates a field which provides good near field deactivation power and which effectively cancels the field generated by each adjacent loop 18 at the far field location. The antenna 10 of the present invention also utilizes power more efficiently and has less electromagnetic field polarization than prior art antennas. Lower electromagnetic field polarization allows the antenna 10 to be positioned in virtually any manner without appreciably effecting the strength of the electromagnetic field.

Figure 5:
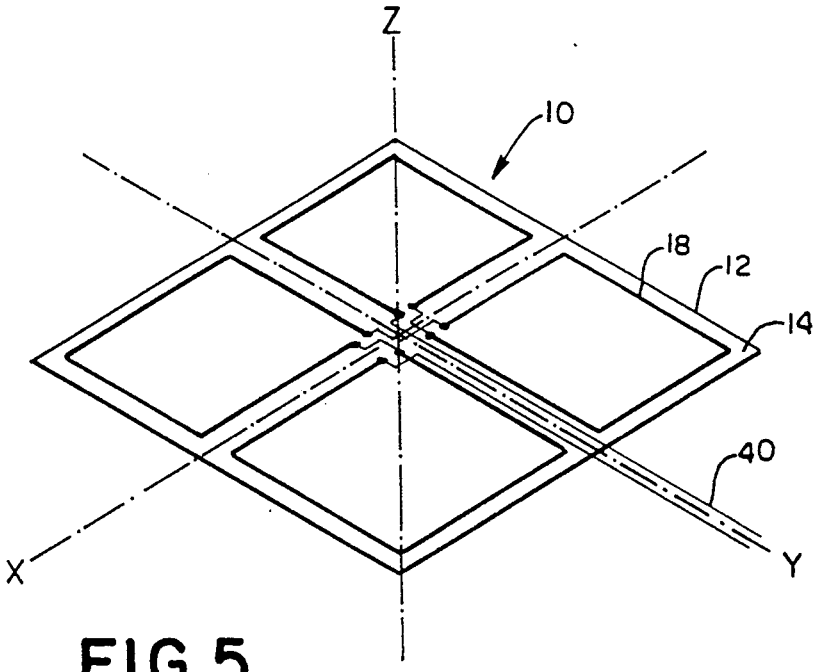
FIG. 5 is a perspective view of the antenna of FIG. 1 with orientation axes.

As best shown in FIG. 1, preferably, the track 20 of each loop 18 includes a first side 30 and a second side 32. For purposes of the following discussion, FIG. 5 shows the deactivating antenna 10 of the present invention oriented with respect to the directions x, y, and z.

The first and second sides 30, 32 provide electromagnetic peaks for deactivating a tag oriented substantially parallel to the y-z plane with respect to the antenna 10. The track 20 preferably further includes a third side 34 and a fourth side 36. The third and fourth sides 34, 36 provide electromagnetic peaks for deactivating a tag oriented substantially parallel to the x-z plane. The centers 38 of each loop provide peaks for deactivating tags oriented substantially parallel to the x-y plane. Therefore, the antenna 10 of the present invention is capable of deactivating tags presented at any orientation with respect to the antenna 10. For example, an antenna 10 measuring 12×12 inches is capable of effectively deactivating a tag at any orientation presented within 5 to 10 inches of the antenna 10. Preferably, the antenna 10 of the present invention has an area of less than 16×16 inches, although one of ordinary skill in the art would understand that the present antenna 10 may be of any size, in accordance with the spirit and scope of the present invention.

Figure 4:
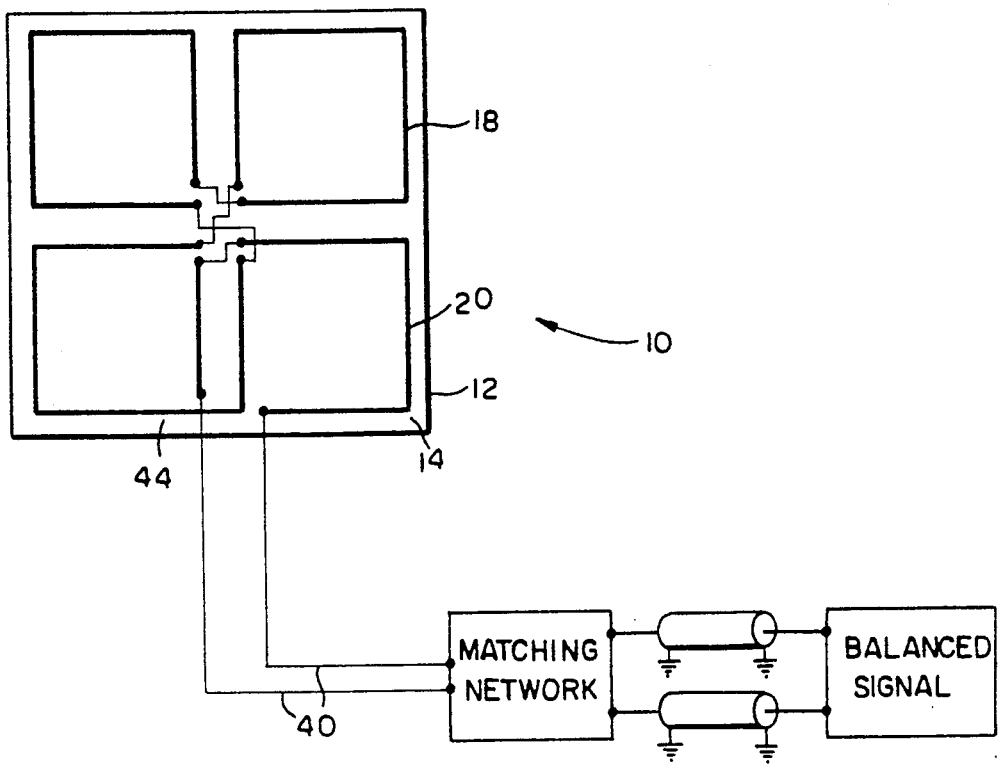
FIG. 4 is a schematic diagram of an alternative embodiment of the antenna of FIG. 1 showing the first side of the dielectric substrate and the antenna loops.

As best shown in FIG. 1, it is preferred that the feed line 40 to the present antenna 10 connects with the loops 18 of the antenna 10 at approximately the center of the loops 18. An alternative embodiment of the present antenna 10 is shown in FIG. 4. An additional advantage of the present antenna 10 is that the feed line 40 may connect with the loops 18 at an edge 44 of the antenna 10. This configuration allows for easy assembly of the antenna 10. One of ordinary skill in the art would understand that the feed line 40 of the antenna 10 of the alternative embodiment may connect with the loops 18 at any edge of the antenna 10, in keeping with the spirit and scope of the present invention.

Figure 2:
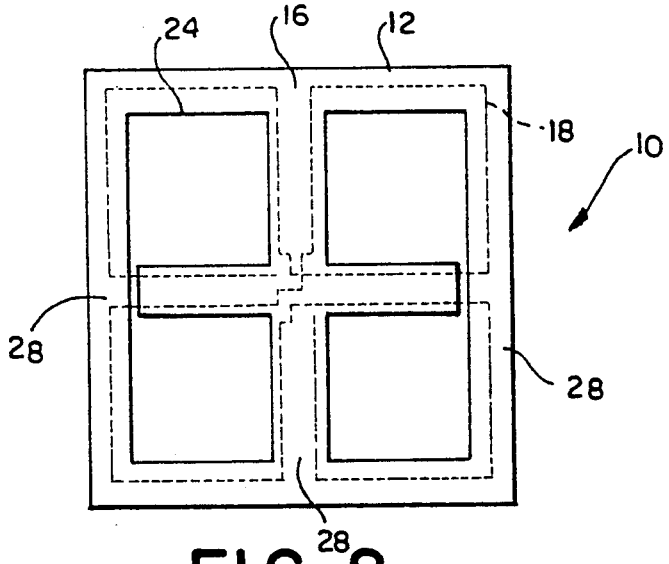
FIG. 2 is a schematic diagram of the antenna of FIG. 1 showing the second side of the dielectric substrate and a ground trace.

As best shown in FIG. 2, the antenna 10 further includes a ground trace 24 on the second side 16 of the substrate 12. It is preferred that the ground trace 24 substantially underlies each printed circuit track 20 and an adjacent portion 26 of each loop area 28. Thus configured, the ground trace 24 provides generally distributed capacitance over each of the antenna loops 18. The ground trace is preferably formed from copper, although the ground trace 24 may be formed from any conductive material, such as brass, aluminum, or steel, or other metals or conductive materials well within the knowledge of one of ordinary skill in the art.

The method for forming the ground trace 24 on the substrate 12 may include etching the ground trace 24 onto the second side 16 of the substrate 12 in a manner similar to that of the conductive loops 18 set forth above. However, one of ordinary skill in the art would understand that the ground trace 24 may be positioned on the second side 16 of the substrate 12 by use of adhesives or other fastening means and any other means well known by one of ordinary skill in the art.

In use, the antenna 10 of the present invention may be positioned within, for example, a checkout counter (not shown) of a retail or other establishment employing an EAS system. The antenna 10 operates as an integral part of a transmitter (not shown) of an EAS system. The transmitter is supplied with energy from a conventional power source, such as a battery or AC or DC power supply. The transmitter and antenna 10 generate an electromagetic field of a predetermined frequency corresponding to the activation frequency of the tags used in the EAS system. When a tag is positioned within the field of the antenna 10, one or more capacitors or other components of the tag become short-circuited resulting in complete deactivation of the tag circuit so that is no longer resonates at all. Alternatively, the resonant frequency of the tag may be shifted so that it is no longer within the frequency range of the EAS system and thus is not detectable.

Many prior art antennas require that the tag be presented at a particular orientation with respect to the antenna. However, the antenna 10 of the present invention effectively deactivates tags presented at any orientation with respect to the antenna 10 while efficiently minimizing far field radiation.

From the foregoing description, it can be seen that the present invention comprises an antenna for transmitting electromagnetic energy for deactivating a resonant circuit of an electronic article surveillance tag. It will be appreciated by those skilled in that art that changes could be made to the embodiments described above without departing from the broad inventive concept thereof. It is understood, that this invention is not limited to the particular embodiment disclosed, but it is intended to cover modifications which are within the spirit and scope of the invention as defined by the appended claims.

I claim:

1. An antenna for transmitting electromagnetic energy for deactivating a resonant circuit of an electronic article surveillance tag without regard to the orientation of the tag while minimizing far field radiation, comprising:

a substantially planar dielectric substrate having a first side and a second side;

four substantially coplanar conductive loops on the first side of the dielectric substrate, the conductive loops being arranged in a two-by-two sequence and connected in series such that current flowing through any one of the conductive loops is out of phase with respect to current flowing in each adjacent conductive loop; and a ground trace on the second side of the substrate.

2. An antenna according to claim 1, wherein the dielectric substrate comprises a printed circuit board and the conductive loops are etched onto the printed circuit board.

3. An antenna according to claim 1, wherein each conductive loop comprises a printed circuit track of predetermined width which defines a loop boundary.

4. An antenna according to claim 3, wherein the area defined by the boundary of each of the loops is generally equal.

5. An antenna according to claim 3, wherein the ground trace substantially underlies each loop printed circuit track and a portion of each loop area.

6. An antenna according to claim 1, wherein each loop has a generally square configuration.

7. An antenna according to claim 1, wherein the loops are connected in series such that the current in each loop flows in a first direction which is opposite to a second direction in which current flows in each adjacent loop.

8. An antenna according to claim 1, wherein the conductive loops are formed of copper.

9. An antenna according to claim 1, wherein the ground trace is formed of copper.

* * * * *